US007942680B2

(12) United States Patent
MacDougall et al.

(10) Patent No.: US 7,942,680 B2
(45) Date of Patent: May 17, 2011

(54) POWER PLATE FOR A SOCKET CONNECTOR

(75) Inventors: Alan Robert MacDougall, Beaverton, OR (US); Steven J. Millard, Mechanicsburg, PA (US); Brian Patrick Costello, Scotts Valley, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/473,771

(22) Filed: May 28, 2009

(65) Prior Publication Data

US 2010/0304603 A1 Dec. 2, 2010

(51) Int. Cl.
*H01R 13/648* (2006.01)

(52) U.S. Cl. ..... 439/108; 439/60

(58) Field of Classification Search ..... 439/60, 439/101, 108, 109
See application file for complete search history.

(56) References Cited

U.S. PATENT DOCUMENTS

| | | | | |
|---|---|---|---|---|
| 4,241,381 | A * | 12/1980 | Cobaugh et al. | 361/785 |
| 4,582,386 | A * | 4/1986 | Martens | 439/631 |
| 5,263,870 | A | 11/1993 | Billman et al. | |
| 6,019,639 | A * | 2/2000 | Brunker et al. | 439/637 |
| 6,358,061 | B1 * | 3/2002 | Regnier | 439/60 |
| 6,462,956 | B1 | 10/2002 | Herrell et al. | |
| 6,558,173 | B1 | 5/2003 | Choy | |
| 6,558,200 | B1 | 5/2003 | Choy | |
| 6,832,933 | B2 | 12/2004 | Bu et al. | |
| 7,410,392 | B2 * | 8/2008 | Szczesny et al. | 439/607.05 |

* cited by examiner

*Primary Examiner* — Thanh-Tam T Le

(57) ABSTRACT

A socket connector includes a housing having a mating interface configured to mate with an electronic component and a mounting interface configured to mount to a circuit board. Signal contacts are held by the housing and extend between the mating interface and the mounting interface. Power contacts are held by the housing and extend between the mating interface and the mounting interface. The power contacts are configured to transmit power from the circuit board to the electronic component. Each of the power contacts have at least one commoning element. A metallic power plate is coupled to the commoning elements of a plurality of the power contacts to electrically common the power contacts to one another.

21 Claims, 9 Drawing Sheets

POWER PLATE FOR A SOCKET CONNECTOR

BACKGROUND OF THE INVENTION

The subject matter herein relates generally to socket connectors, and more particularly, to power plates for socket connectors.

Electronic devices, such as computers, workstations and servers, may use numerous types of electronic modules, such as processors and memory modules (e.g. Dynamic Random Access Memory (DRAM), Synchronous Dynamic Random Access Memory (SDRAM), Double Data Rate (DDR) SDRAM, DDR2 SDRAM, DDR3 SDRAM, DDR4 SDRAM, or Extended Data Out Random Access Memory (EDO RAM), and the like). The memory modules are produced in a number of formats such as, for example, Single In-line Memory Module (SIMM), or Dual In-line Memory Modules (DIMM). Typically, the memory modules have a circuit board that is installed in a multi-pin socket connector mounted on a system board or motherboard. Each memory module has a card edge that provides an interface generally between two rows of contacts in the socket connector. The memory modules include memory devices mounted on the circuit board that store data for the electronic device. The memory devices require power to operate, and the power is supplied to the memory devices by the contacts within the socket connector.

Known electronic devices having memory modules are not without disadvantages. For instance, the power requirement to operate the memory devices has increased over time as the electronic devices are designed to operate more quickly and/or as the amount of data being stored by the memory devices is increased. The mating interface between the system board and the socket connector is a bottleneck for transfer of power to the memory modules. For example, voltage tolerances are becoming tight at high speeds as voltage levels are dropping and the current used by the memory modules is rising. The voltage drop on the power contacts is particularly problematic as the current for the memory modules is changing at a high differential from, for example, a low static power to a high active charging power. Another factor affecting the powering problem is that voltage regulation is typically performed by a voltage regulator upstream of the socket interface before the power flows through the socket connector to the memory card. High inductance for the power path is pan of the problem as well as resistance, voltage regulation point, and the number of memory modules per voltage regulator.

BRIEF DESCRIPTION OF THE INVENTION

In one embodiment, a socket connector is provided including a housing having a mating interface configured to mate with an electronic component and a mounting interface configured to mount to a circuit board. Signal contacts are held by the housing and extend between the mating interface and the mounting interface. Power contacts are held by the housing and extend between the mating interface and the mounting interface. The power contacts are configured to transmit power from the circuit board to the electronic component. Each of the power contacts have at least one commoning element. A metallic power plate is coupled to the commoning elements of a plurality of the power contacts to electrically common the power contacts to one another.

In another embodiment, a socket connector is provided that includes a housing having a mating interface configured to mate with an electronic component and a mounting interface configured to mount to a circuit board. Signal contacts are held by the housing and extend between the mating interface and the mounting interface. Power contacts are held by the housing and extend between the mating interface and the mounting interface. The power contacts are configured to transmit power from the circuit board to the electronic component. Each of the power contacts have at least one commoning element. A power plate is coupled to the commoning elements of a plurality of the power contacts to electrically common the power contacts to one another. The power plate is loaded onto the commoning element and secured to the power contact by an interference engagement with the commoning element.

In a further embodiment, a socket connector is provided including a housing extending along a connector axis, signal contacts held by the housing that are parallel to one another and spaced apart along the connector axis, and power contacts held by the housing that are parallel to one another and spaced apart along the connector axis. Each of the power contacts includes at least one commoning element. A power plate extends along a plate axis generally parallel to the connector axis. The power plate has a band extending along the plate axis and a plurality of arms extending outward from the band in a direction generally perpendicular to the plate axis. The power plate is coupled to the commoning elements of a plurality of the power contacts to electrically common the power contacts to one another. Adjacent arms engage different power contacts.

DETAILED DESCRIPTION OF THE INVENTION

Figure 1:
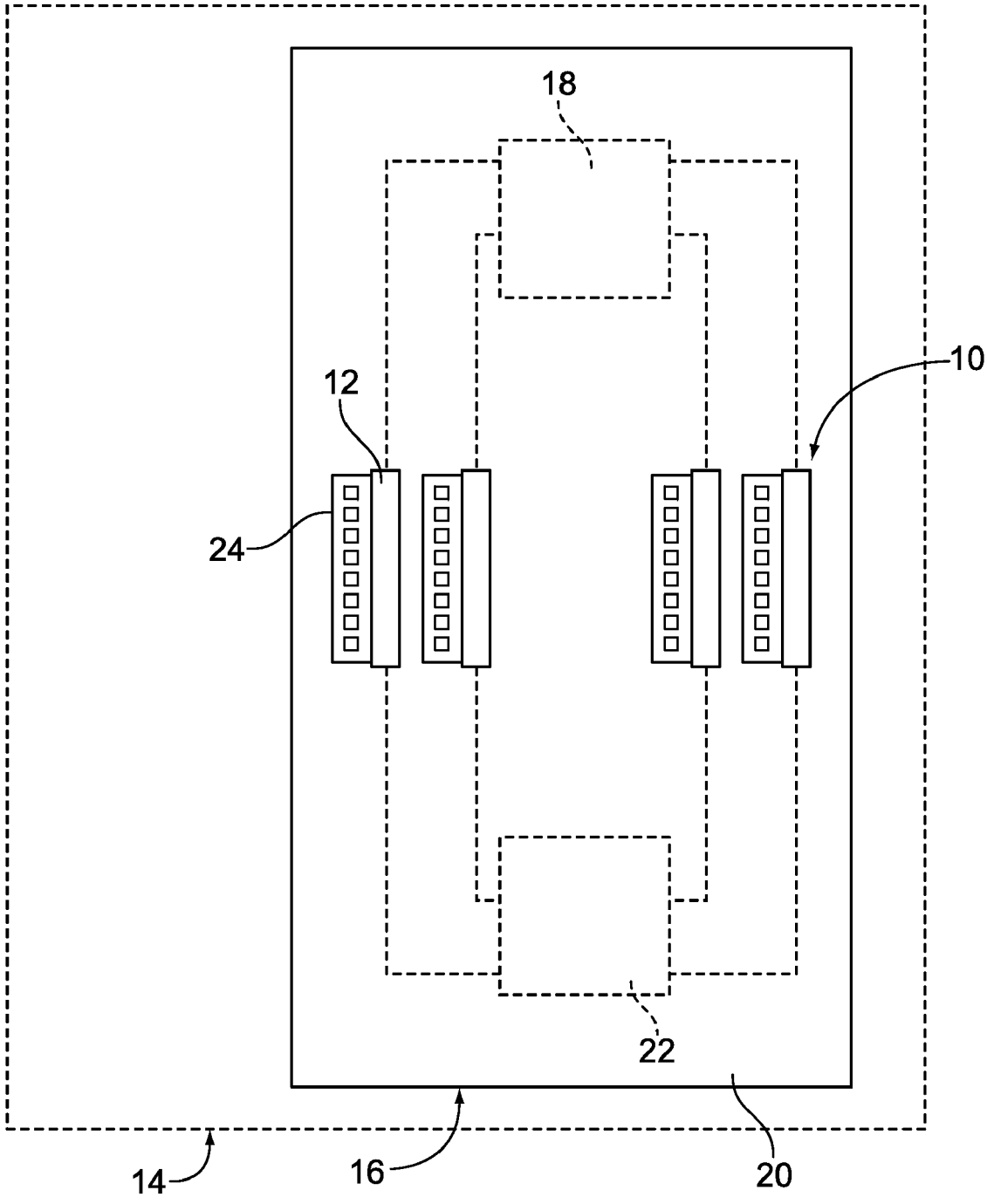
FIG. 1 is a schematic illustration of an electronic device utilizing a connector system in accordance with an exemplary embodiment.

FIG. 1 is a perspective view of a connector system 10 having a socket connector 12 formed in accordance with an exemplary embodiment The connector system 10 is used within an electronic device 14 as part of a memory system 16, which are represented schematically in FIG. 1. The socket connector 12 may be used within systems other than a memory system 16 in alternative embodiments, and the memory system 16 is merely illustrative of one type of electronic system that may utilize the socket connector 12.

The memory system 16 stores data for the electronic device 14. The electronic device 14 may be any type of electronic device such as, for example, a computer, a workstation, a server, and the like. The electronic device 14 may include one or more electronic modules 18, such as a processor. Optionally, the electronic module 18 may be connected with the memory system 16. For example, the electronic module 18 may be electrically connected to a motherboard or system board 20. The electronic device 14 may also include one or more power sources 22. Optionally, the power source 22 may be connected with the memory system 16. For example, the power source 22 may be electrically connected to the system board 20.

In an exemplary embodiment, the memory system 16 includes one or more electronic components in the form of memory modules 24 mounted to corresponding socket connectors 12. Other types of electronic components may be connected by the connector system 10 in alternative embodiments. The memory module 24 may constitute a Synchronous Dynamic Random Access Memory (SDRAM) module. Optionally, the memory module 24 may be a Dual In-line Memory Module (DIMM module). Any number of memory modules 24 and socket connectors 12 may be provided within the memory system 16. Additionally, any number of memory systems 16 may be provided within the electronic device 14.

In an exemplary embodiment, the memory module 24 is electrically connected to one or more data devices, such as the electronic module 18, for sending data thereto and/or receiving data therefrom. The memory module 24 stores data generated by the data device and/or sends stored data to the data device. Optionally, the memory module 24 may be connected to the data device via the system board 20. For example, the data device may be coupled directly to the system board 20, or alternatively, may be provided remote from the system board 20 and connected thereto by an electrical connection. The memory module 24 is electrically connected to one or more power source 22 for powering the memory module 24. The memory module 24 may be connected to the power source 22 via the system board 20. The power source 22 may be directly coupled to the system board 20, or alternatively, may be provided remote from system board 20 and connected thereto by an electrical connection.

Figure 2:
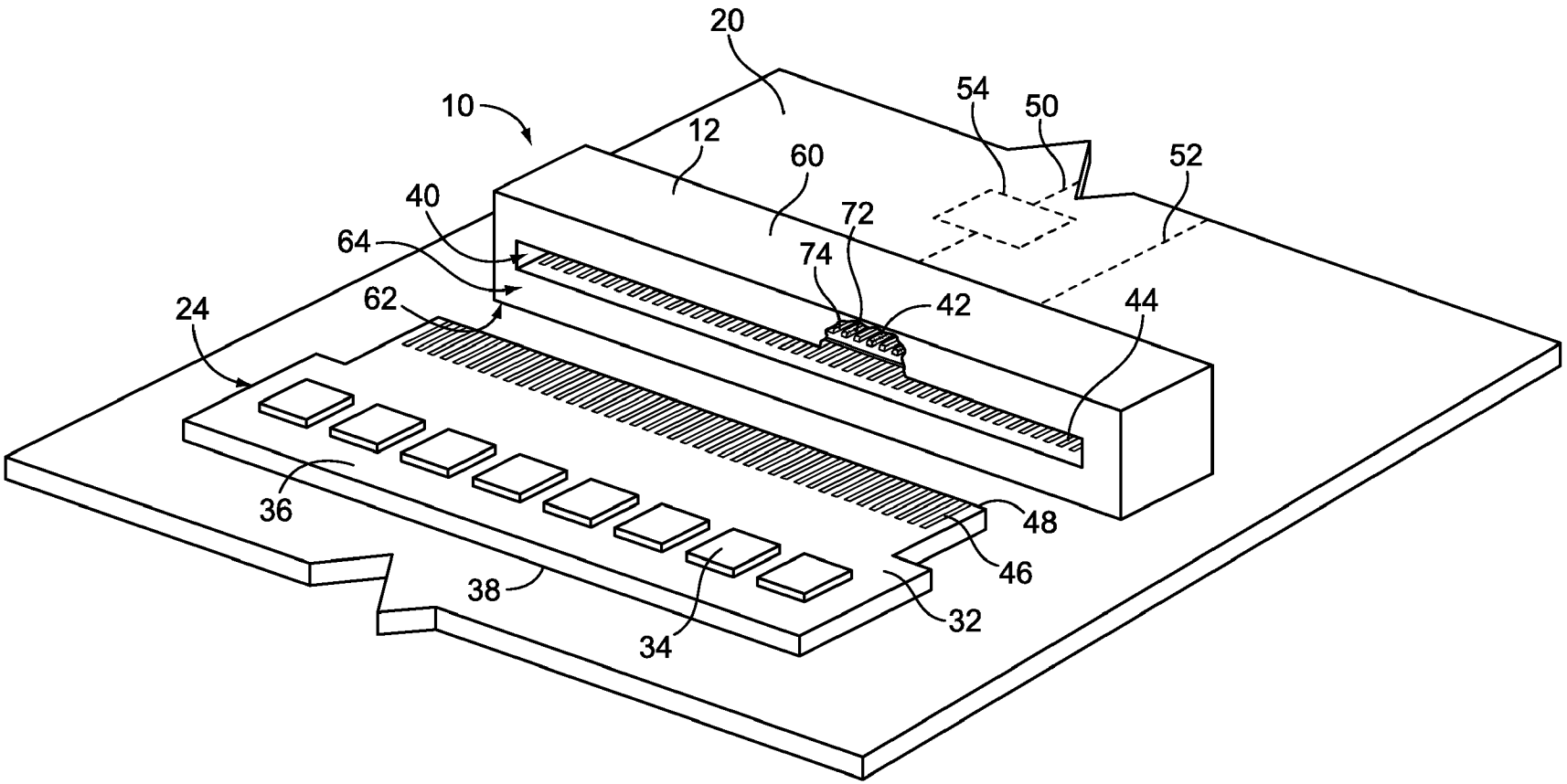
FIG. 2 is a perspective view of the connector system having a socket connector formed in accordance with an exemplary embodiment.

FIG. 2 is a perspective view of the connector system 10 showing the socket connector 12. The memory module 24 is illustrated in an unmated state prior to being plugged into the socket connector 12.

The memory module 24 includes a circuit board 32 and a plurality of memory devices 34 coupled to the circuit board 32. The memory devices 34 may be integrated circuit (IC) chips or other electronic components for storing data. Any number of memory devices 34 may be electrically connected to the circuit board 32. In the illustrated embodiment, eight memory devices are mounted to a first side 36 of the circuit board 32. Memory devices 34 may also be mounted to a second side 38 of the circuit board 32.

The memory module 24 is electrically connected to the system board 20 by the socket connector 12. In the illustrated embodiment, the socket connector 12 constitutes a card edge connector having a slot 40 that receives the memory module 24 therein. A plurality of socket contacts are arranged in one or more rows within the slot 40 for mating with the memory module 24. For example, the socket connector 12 may include upper socket contacts 42 and lower socket contacts 44 that mate with contact pads 46 arranged at an edge 48 of the circuit board 32 when the circuit board 32 is plugged into the card edge slot 40. The upper socket contacts 42 are arranged in an upper row along one side of the slot 40 and the lower socket contacts 44 are arranged in a lower row along another side of the slot 40 generally opposite to the upper socket contacts 42.

The socket connector 12 holds the circuit board 32 of the memory module 24 parallel to the system board 20. For example, the system board 20 may have a generally horizontal orientation and the circuit board 32 may also have a generally horizontal orientation at a spaced apart position either above or below the system board 20. Such a configuration defines a low profile connector system 10 with respect to the system board 20 because the overall height of the connector system 10 is the same as the height of the socket connector 12. The memory module 24 does not extend above the socket connector 12. Alternatively, the socket connector 12 may be configured to orient the circuit board 32 at a right angle with respect to the system board 20. For example, the system board 20 may have a generally horizontal orientation and the circuit board 32 may have a generally vertical orientation. In such configuration, two rows of socket contacts are provided on either side of the vertically extending slot. Each row of socket contacts may have both power and signal contacts. As described below, the power contacts in both rows may be electrically commoned together. In an exemplary embodiment, the system board 20 relays both power and data, represented by power and data paths 50, 52, respectively, to and/or from the memory module 24 via the socket connector 12.

Optionally, one or more voltage regulator modules 54 may be electrically connected to the system board 20. The voltage regulator modules 54 control the flow of power along the power path 50. The voltage regular module 54 includes a plurality of components, such as resistors, capacitors, traces and/or contacts, that are part of a power circuit for controlling the flow of power to the memory module 24. The components manipulate the power coming into the voltage regulator module 54 such that the power output has different power characteristics than the power input. For example, the power circuit may control and/or regulate a voltage, a current, or another power characteristics of the power output.

The socket connector 12 includes a housing 60 having a mounting interface 62 at a bottom of the socket connector 12 that is mounted to the system board 20. The housing 60 includes a mating interface 64 defined at the front of the socket connector 12 for mating with the memory module 24. The front is oriented at a right angle with respect to the bottom. The slot 40 is open along the front for receiving the memory module 24. The socket contacts 42, 44 may have a predetermined contact pattern for mating with a particular type of memory module 24. The upper socket contacts 42 are generally arranged at a rear of the housing 60, generally opposite the mating interface 64, and extend into the slot 40. The lower socket contacts 44 are generally arranged at a front of the housing 60 and extend into the slot 40 to define part of the mating interface 64. Optionally, a subset of the upper and/or lower socket contacts 42, 44 may define power contacts 72 and another subset of the socket contacts 42, 44 may define signal or data contacts 74. The socket contacts 42, 44 may define other types of contacts as well, such as ground contacts. The power contacts 72 transmit the power routed by the system board 20 to the memory module 24. The data contacts 74 transmit the data between the system board 20 and the memory module 24. In an alternative embodiment, the power contacts 72 may be structurally different than the data contacts 74. For example, the power contacts 72 may have a different size and shape and/or the power contacts 72 may be made from a different material or have a different coating.

Figure 3:
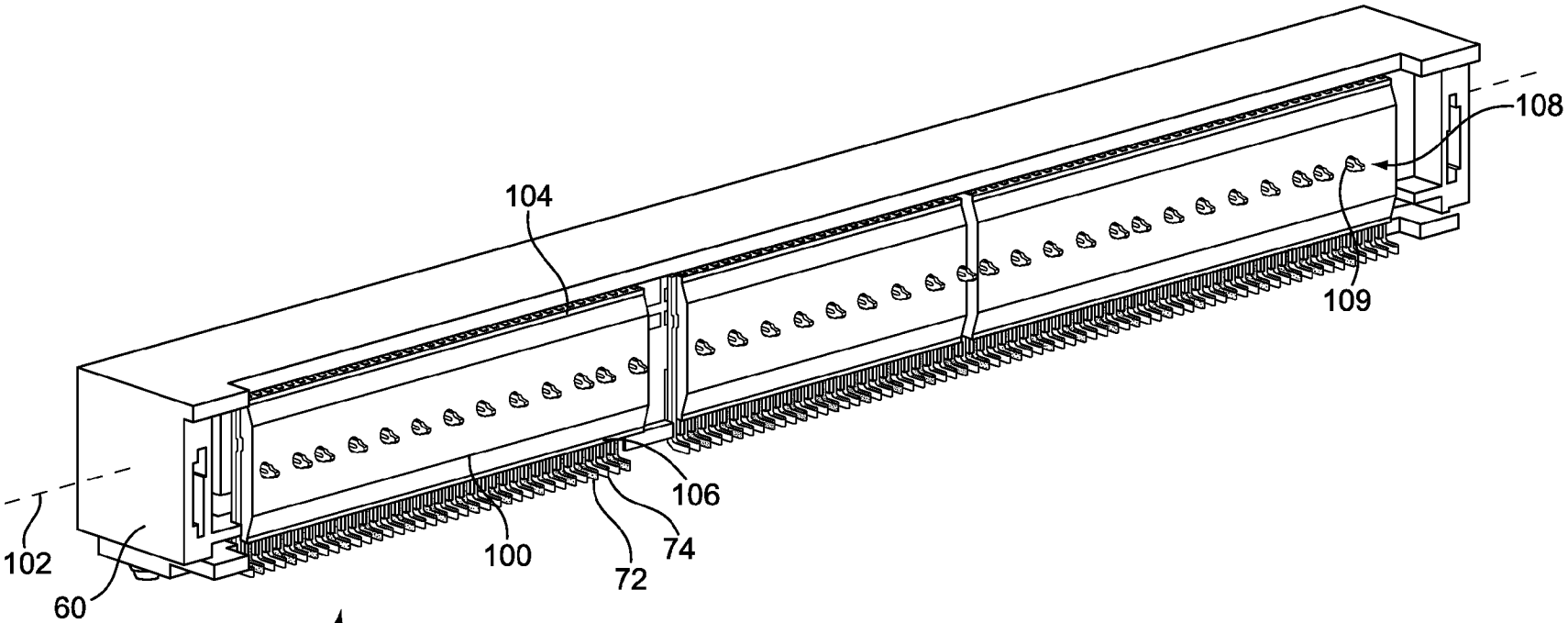
FIG. 3 is a rear perspective view of the socket connector shown in FIG. 2 showing a power plate of the socket connector.

FIG. 3 is a rear perspective view of the socket connector 12 showing power plates 100 connected to the rear of the socket connector 12. The power plates 100, are connected to the power contacts 72 to electrically common a plurality of the power contacts 72 to one another. The power plates 100 define a secondary power or current path between the top and the bottom of the power contacts 72 that is parallel to the power path defined by the power contacts 72. In the illustrated embodiment, multiple power plates 100 are provided that electrically common different subsets of the power contacts 72 together. Any number of power plates 100 may be utilized, depending on the particular application.

The housing 60 extends along a connector axis 102 between opposed sides of the housing 60. The top, bottom, front and rear of the housing 60 are parallel to the connector axis 102. The connector axis 102 is the longitudinal axis of the socket connector 12. The power plates 100 define the secondary power or current paths that are oriented generally perpendicular to the connector axis 102.

Each power plate 100 includes a metallic body extending between an upper end 104 and a lower end 106. The power plate 100 has a width defined between the upper end 104 and the lower end 106. The secondary power path provided by the power plate 100 is defined generally along the width of the power plate 100 between the upper and lower ends 104, 106. The power plate 100 is convex with the upper and lower ends 104, 106 engaging the power contacts 72. A central portion 108 of the power plate 100 is bowed outward from the upper and lower ends 104, 106 to give the power plate 100 a convex shape. When the power plate 100 is connected to the power contacts 72, the central portion 108 may be deflected and flexed toward the power contacts 72. The power plate 100 includes a plurality of openings 109 at the central portion 108. The openings 109 receive portions of the power contacts 72 to secure the power plate 100 to the power contacts 72.

Figure 4:
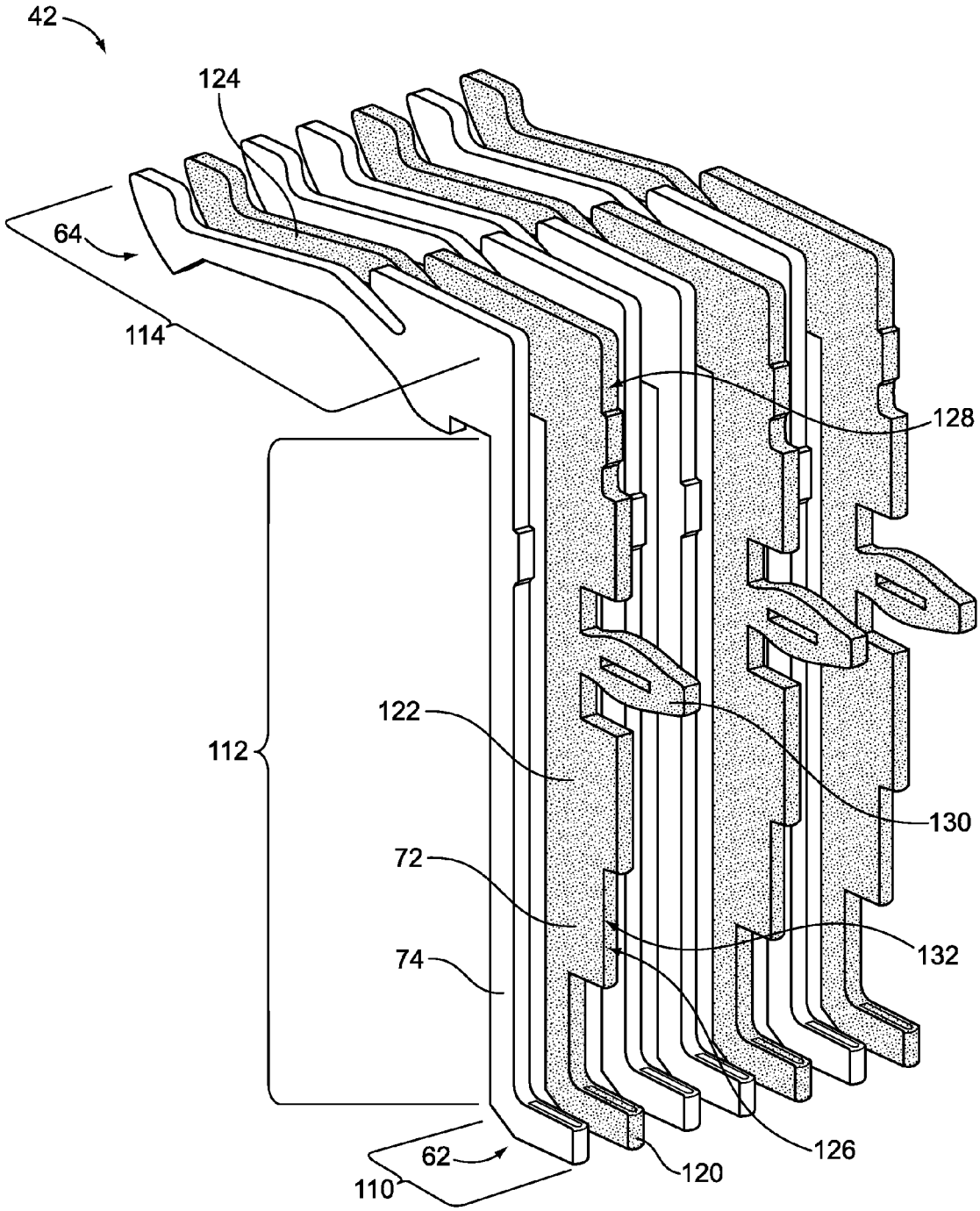
FIG. 4 is a side perspective view of a plurality of contacts for the socket connector.

FIG. 4 is a side perspective view of a plurality of upper socket contacts 42 for the socket connector 12 (shown in FIG. 3). The housing 60 (shown in FIG. 3) is removed for clarity. Both power and signal contacts 72, 74 are illustrated. The power and signal contacts 72, 74 are interspersed among one another in a predetermined pattern. Any number of signal contacts 72 may be positioned between adjacent power contacts 74, and vice versa. The power and signal contacts 72, 74 generally extend along parallel planes with respect to one another. The rear edge of the power contacts 72 generally extend further rearward than the rear edge of the signal contacts 74.

The socket contacts 42 extend between, and define a portion of, the mounting interface 62 and the mating interface 64 of the socket connector 12. Each signal contact 74 includes a contact tail 110 at the mounting interface 62 for mounting to the system board 20 (shown in FIG. 2). Optionally, the contact tail 110 may be surface mounted to the system board 20, such as by soldering to the system board 20. Alternatively, the contact tail 110 may be through hole mounted to a via in the system board 20. Other connection configurations are possible in other embodiments.

Each signal contact 74 includes a contact base 112 extending perpendicular from the mounting interface 62 along the rear of the housing 60 (shown in FIG. 3). The contact base 112 extends from the contact tail 110 to a contact beam 114, which extends from the contact base 112. Optionally, the contact beam 114 may extend generally perpendicular from the contact base 112. Alternatively, the contact beam 114 may extend at a non-perpendicular angle from the contact base 112. The contact beam 114 is exposed within the slot 40 (shown in FIG. 2) at the mating interface 64 for mating with the circuit board 32 (shown in FIG. 2).

Each power contact 72 includes a contact tail 120 at the mounting interface 62 for mounting to the system board 20. Optionally, the contact tail 120 may be surface mounted to the system board 20, such as by soldering to the system board 20. Alternatively, the contact tail 120 may be through hole mounted to a via in the system board 20. Each power contact 72 includes a contact base 122 extending perpendicular from the mounting interface 62 along the rear of the housing 60. The contact base 122 extends from the contact tail 120 to a contact beam 124, which extends from the contact base 122. Optionally, the contact beam 124 may extend generally perpendicular from the contact base 122. Alternatively, the contact beam 124 may extend at a non-perpendicular angle from the contact base 122. The contact beam 124 is exposed within the slot 40 at the mating interface 64 for mating with the circuit board 32.

The power contact 72 includes at least one commoning element 126. The power plate 100 (shown in FIG. 3) is connected to the commoning element 126 to electrically common the power contact 72 and the power plate 100. In the illustrated embodiment, the power contact 72 includes an upper commoning element 128, a central commoning element 130, and a lower commoning element 132. The power plate 100 may engage any or all of the commoning elements 128, 130, 132 to create the secondary power path therebetween. Multiple connection points with multiple commoning elements 128, 130, 132 aides electrical connection between the power plate 100 and the power contact 72, however, a single connection point will suffice to create the electrical connection therebetween for commoning multiple power contacts 72 together. The upper and lower commoning elements 128, 132 constitute planar surfaces or edges of the power contact 72. The power plate 100 is configured to engage the edges of the power contact 72 at the upper and lower commoning elements 128, 132. The central commoning element 130 constitutes an eye-of-the-needle type pin that extends outward from the power contact 72. The central commoning element 130 is received within the opening 109 (shown in FIG. 3) of the power plate 100 and is connected thereto by an interference engagement. The power contact 72 may include other types of commoning elements 126 and/or more or less than the three commoning elements 126 describe above.

Figure 5:
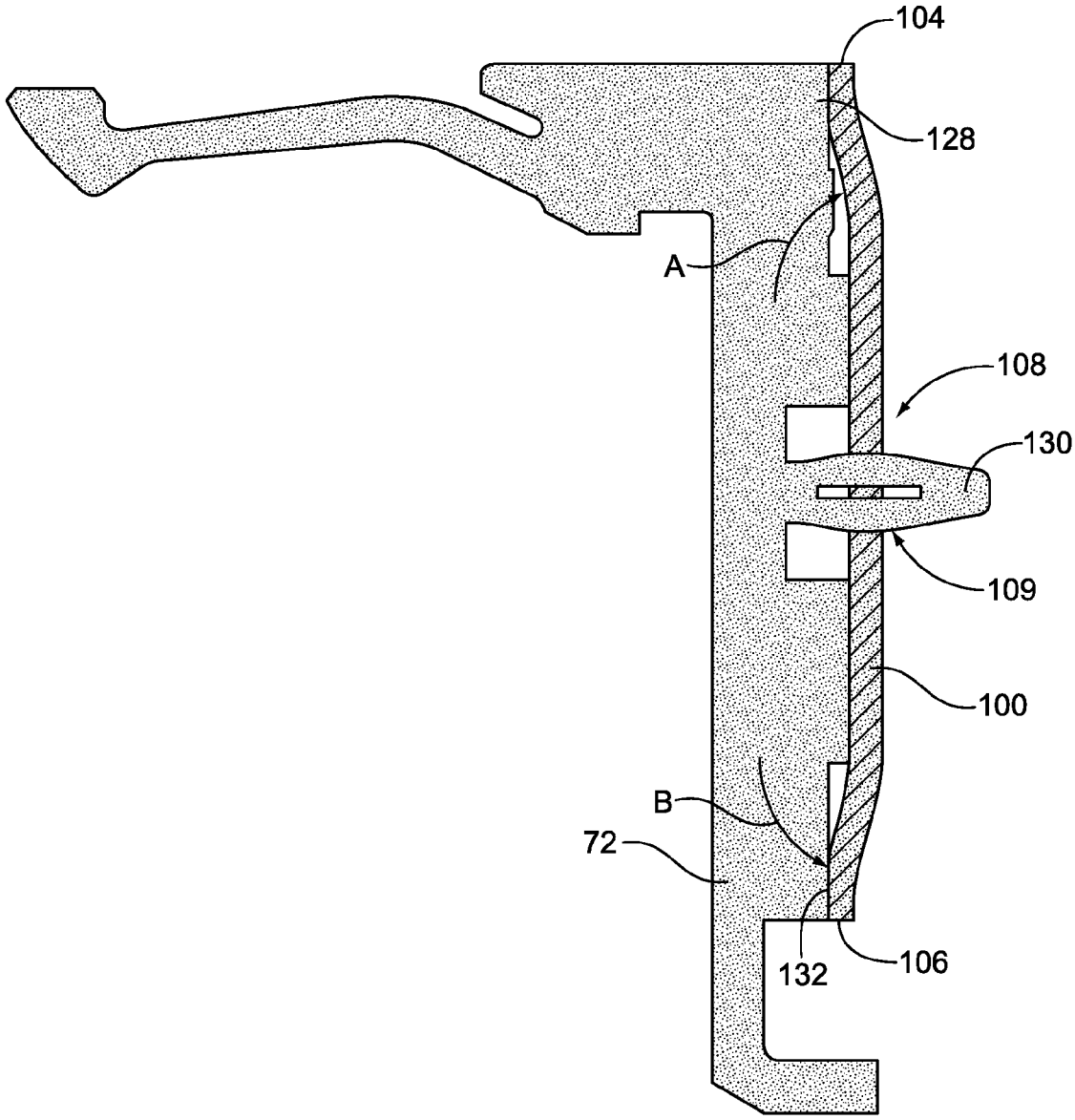
FIG. 5 is a side view of one of the contacts with the power plate connected to the contact.

FIG. 5 is a side partial sectional view of one of the power contacts 72 with the power plate 100 connected to the power contact 72. The central commoning element 130 extends through the opening 109 in the power plate 100. The power plate 100 is secured to the central commoning element 130 by an interference engagement. The upper end 104 of the power plate 100 engages the upper commoning element 128. The lower end 106 of the power plate 100 engages the lower commoning element 132. The secondary power path provided by the power plate 100 extends between the upper and lower commoning elements 128, 132.

The power plate 100 is convex in shape with the upper and lower ends 104, 106 extending from the central portion 108. During assembly, the central portion 108 is pushed inward toward the power contact 72, which forces the upper and lower ends 104, 106 to deflect relative to the central portion 108, such as in the directions of arrows A and B, respectively. When the upper and lower ends 104, 106 are deflected, the ends 104, 106 are biased against the power contact 72 and held against the commoning elements 128, 132 by an interference engagement caused by the spring force of the power plate 100 against the power contact 72. The central portion 108 is held in place by the interference engagement with the central commoning element 130. Alternatively, the power plate 100 may be held in position by another component, such as a cover (not shown) that is secured to the rear of the housing 60 (shown in FIG. 2) and that holds the power plate 100 in physical contact with the power contact 72. When the upper and lower ends 104, 106 are deflected outward, the power plate 100 is more planar than the initial concave shape to a final shape, such as the shape illustrated in FIG. 5. The final shape is also a convex shape, however, the power plate 100 is flatter than the initial shape. Alternatively, the final shape may be generally planar or flat along the edge of the power contact 72.

The power plate 100 provides a parallel current path from the upper portion of the power contacts 72 to the lower portion of the power contacts 72. In an exemplary embodiment, the power plate 100 has a high conductivity and/or a low resistance. The power plate 100 is placed in close proximity to all the corresponding power contacts 72 to provide a lower inductance for the socket connector 12. The power plate 100 makes connection to both the top and bottom of as many, and potentially all, of the power contacts 72. Connecting to multiple power contacts 72 provides a low resistance current path for each of the power contacts 72 that is in parallel to the power paths of each of the other power contacts 72, which provides a total resistive path that is much lower than the power contacts 72 alone. The power plate 100 is in close proximity to each of the other power contacts 72 to help lower the total power contact inductance, which will help reduce voltage drop through the socket connector 12 during high transient power switching times. By lowering the resistance and/or the inductance, the performance of the socket connector 12 is increased.

Figure 6:
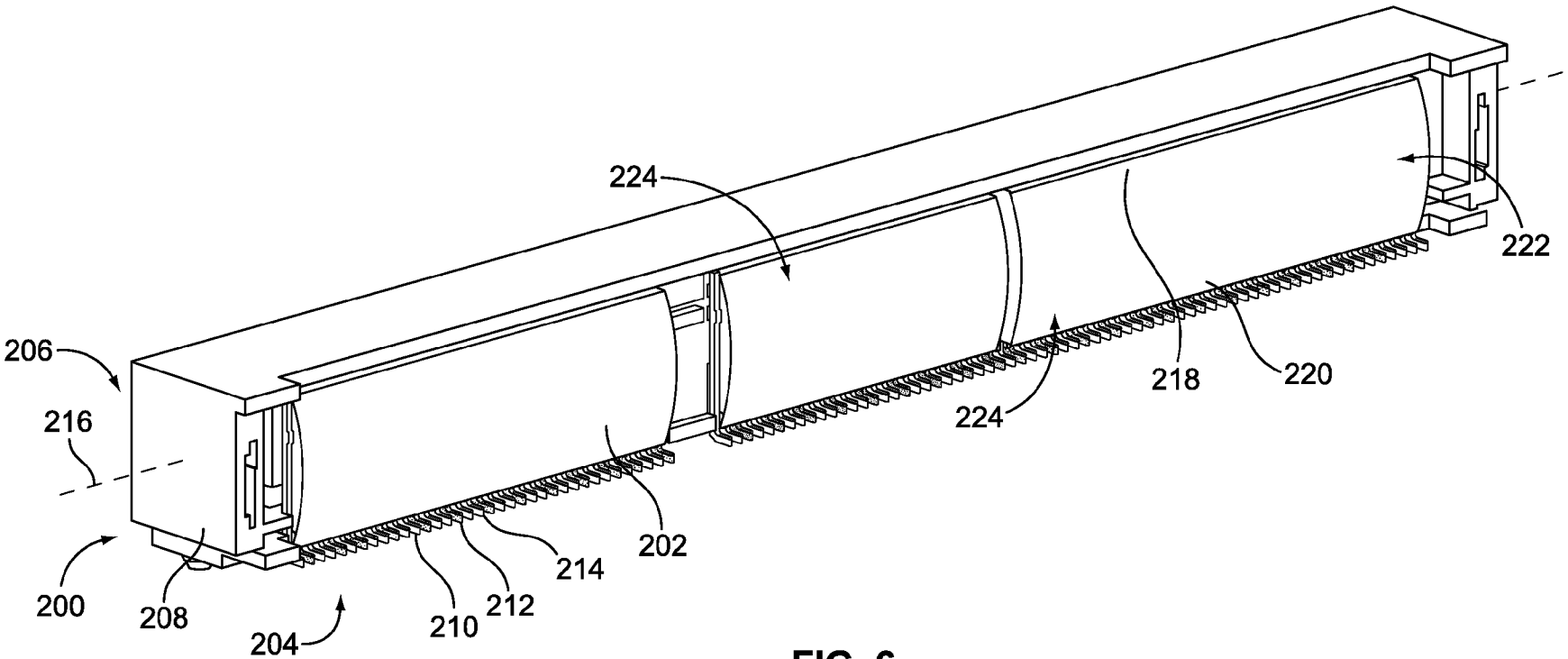
FIG. 6 is a rear perspective view of an alternative socket connector showing an alternative power plate.

FIG. 6 is a rear perspective view of an alternative socket connector 200 showing an alternative power plate 202. The socket connector 200 is similar to the socket connector 12, such as at a mounting interface 204 and a mating interface 206, which may be substantially similar to the mounting interface 62 and the mating interface 64, respectively. As such, the socket connector 200 may be used interchangeably with the socket connector 100 for mating with the same or a similar system board 20 (shown in FIG. 2) and/or for mating with the same or a similar electronic component, such as the circuit board 32 of the memory module 24 (shown in FIG. 2). The socket connector 200 includes a housing 208 that may be similar to or identical to the housing 60 (shown in FIG. 2).

Some of the differences between the socket connector 200 and the socket connector 12 are that the socket connector 200 includes socket contacts 210 that differ from the socket contacts of the socket connector 12. The socket contacts 210 may constitute both power contacts 212 and signal contacts 214. Optionally, only the power contacts 212 differ from the power contacts 72 (shown in FIG. 2) of the upper socket contacts 42 (shown in FIG. 2) while the signal contacts 214 are the same as the signal contacts 74 (shown in FIG. 2) of the upper socket contacts 42. Alternatively, both the signal and power contacts 212, 214 may be different than the signal and power contacts 72, 74. The socket connector 200 may also include lower socket contacts (not shown) that are similar to the lower socket contacts 44 (shown in FIG. 2). The power plates 200 differ from the power plates 100 (shown in FIG. 3) and connect to the power contacts 212 in a different manner.

The power plates 202 are connected to the power contacts 212 to electrically common a plurality of the power contacts 212 to one another. The power plates 202 define secondary power or current paths between the top and the bottom of the power contacts 212 that is parallel to the power path defined by the power contacts 212. In the illustrated embodiment, multiple power plates 202 are provided that electrically common different subsets of the power contacts 212 together. Any number of power plates 202 may be utilized, depending on the particular application.

The housing 208 extends along a connector axis 216 between opposed sides of the housing 208. The top, bottom, front and rear of the housing 208 are parallel to the connector axis 216. The connector axis 216 is the longitudinal axis of the socket connector 200.

Each power plate 202 includes a metallic body extending between an upper end 218 and a lower end 220. The power plate 200 is convex with the tipper and lower ends 218, 220 engaging the power contacts 212. A central portion 222 of the power plate 202 is bowed outward from the upper and lower ends 218, 220 to give the power plate 202 a convex shape. When the power plate 202 is connected to the power contacts 212, the central portion 222 may be deflected and flexed toward the power contacts 212. The power plate 202 is folded over at the upper and lower ends 218, 220 to define clips 224 at the upper and lower ends 218, 220. The clips 224 engage portions of the power contacts 212 to secure the power plate 202 to the power contacts 212.

Figure 7:
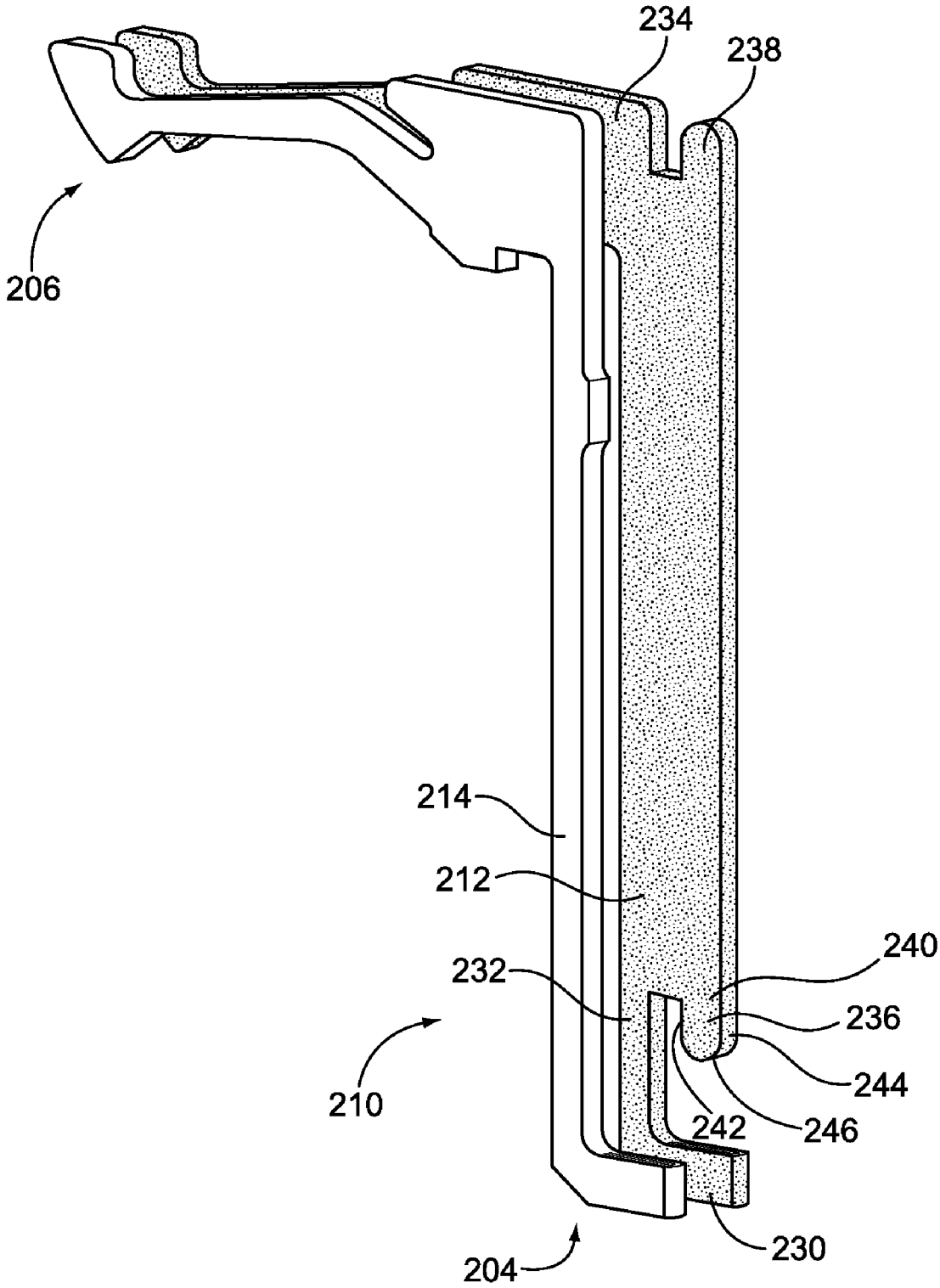
FIG. 7 is a side perspective view of a plurality of contacts for the socket connector shown in FIG. 6.

FIG. 7 is a side perspective view of a plurality of the socket contacts 210 for the socket connector 200 (shown in FIG. 6). Both power and signal contacts 212, 214 are illustrated. The socket contacts 210 extend between, and define a portion of, the mounting interface 204 and the mating interface 206 of the socket connector 200. Each power contact 212 includes a contact tail 230 at the mounting interface 204 for mounting to a circuit board, such as the system board 20 (shown in FIG. 2). Optionally, the contact tail 230 may be surface mounted to the system board, such as by soldering to the system board. Alternatively, the contact tail 230 may be through hole mounted to a via in the system board. Each power contact 212 includes a contact base 232 extending perpendicular from the mounting interface 204. The contact base 232 extends from the contact tail 230 to a contact beam 234, which extends from the contact base 232. Optionally, the contact beam 234 may extend generally perpendicular from the contact base 232. Alternatively, the contact beam 234 may extend at a non-perpendicular angle from the contact base 232. The contact beam 234 is exposed at the mating interface 206 for mating with the electronic component.

The power contact 212 includes at least one commoning element 236. The power plate 202 (shown in FIG. 6) is connected to the commoning elements) 236 to electrically common the power contact 212 and the power plate 202. In the illustrated embodiment, the power contact 212 includes an upper commoning element 238 and a lower commoning element 240. The power plate 202 engages each of the commoning elements 238, 240 such that the power plate 202 has multiple connection points with each power contact 212. In the illustrated embodiment, the upper and lower commoning elements 238, 240 constitute mounting tabs, and may be referred to hereinafter as upper and lower mounting tabs 238, 240, respectively. The mounting tabs 238, 240 each have an inner surface 242, an outer surface 244 and an edge 246 extending therebetween. The edge 246 of the upper mounting tab 238 faces upward and the edge 246 of the lower mounting tab 240 faces downward. The power plate 202 engages at least one of the inner surface 242, the outer surface 244 and the edge 246 to make electrical contact with the power contact 212. The power contact 212 may include other commoning elements 236 that are engaged by the power plate 202.

Figure 8:
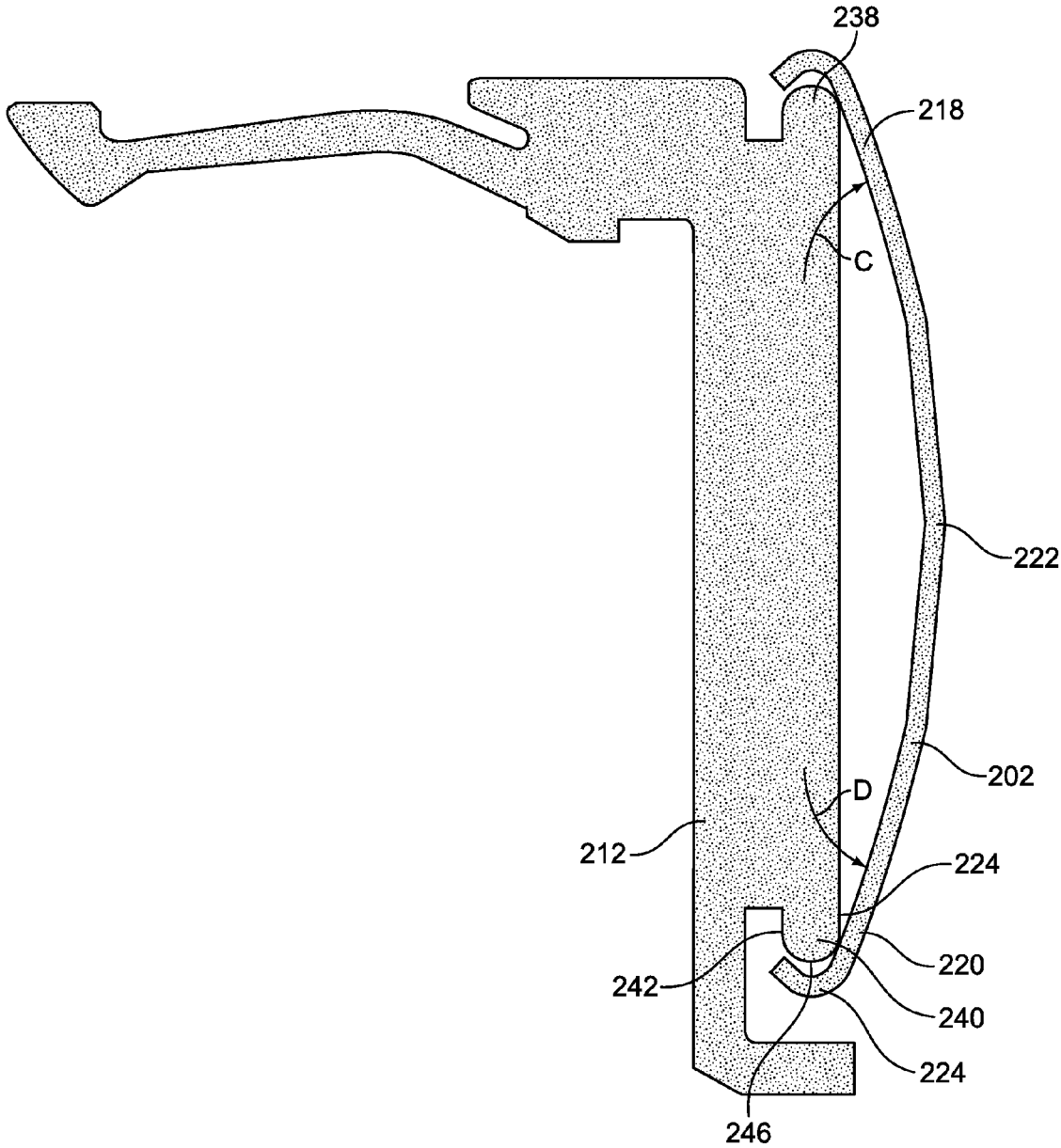
FIG. 8 is a side view of one of the contacts shown in FIG. 6 with the power plate of FIG. 6 connected thereto.

FIG. 8 is a side view of one of the power contacts 212 with the power plate 202 connected to the power contact 212. The power plate 202 is secured to the upper and lower mounting tabs 238, 240 by an interference engagement. For example, the upper and lower clips 224 wrap at least partially around the mounting tabs 238, 240 to engage at least one of the inner surface 242, the outer surface 244 and the edge 246. The body of the power plate 202 is spring-like and forces the upper and lower clips 224 against the mounting tabs 238, 240.

The power plate 202 is convex in shape with the upper and lower ends 218, 220 extending from the central portion 222. During assembly, the central portion 222 is pushed inward toward the power contact 212, which forces the upper and lower ends 218, 220 to deflect relative to the central portion 222, such as in the directions of arrows C and D, respectively. Optionally, one of the clips 224 may be placed on the corresponding commoning element 238, 240 and then the central portion 222 pushed inward to widen the power plate 202 such that the other clip 224 may be placed over the other commoning element 238, 240. The central portion 222 is held in place by the interference engagement with the upper and lower mounting tabs 238, 240. Alternatively, the power plate 202 may be held in position by another component that holds the power plate 202 in physical contact with the power contact 212. When the upper and lower ends 218, 220 are deflected outward, the power plate 202 is straightened from the initial concave shape to a final shape, such as the shape illustrated in FIG. 8.

The power plate 202 provides a parallel current path from the upper portion of the power contacts 212 to the lower portion of the power contacts 212. In an exemplary embodiment, the power plate 202 has a high conductivity and/or a low resistance. The power plate 202 is placed in close proximity to all the corresponding power contacts 212 to provide a lower inductance for the socket connector 200 (shown in FIG. 6). The power plate 202 makes connection to both the top and bottom of as many, and potentially all, of the power contacts 212. Connecting to multiple power contacts 212 provides a low resistance current path for each of the power contacts 212 that is in parallel to the power paths of each of the other power contacts 212, which provides a total resistive path that is much lower than the power contacts 212 alone. The power plate 202 is in close proximity to each of the other power contacts 212 to help lower the total power contact inductance, which will help reduce voltage drop through the socket connector 200 during high transient power switching times. By lowering the resistance and/or the inductance, the performance of the socket connector 200 is increased.

Figure 9:
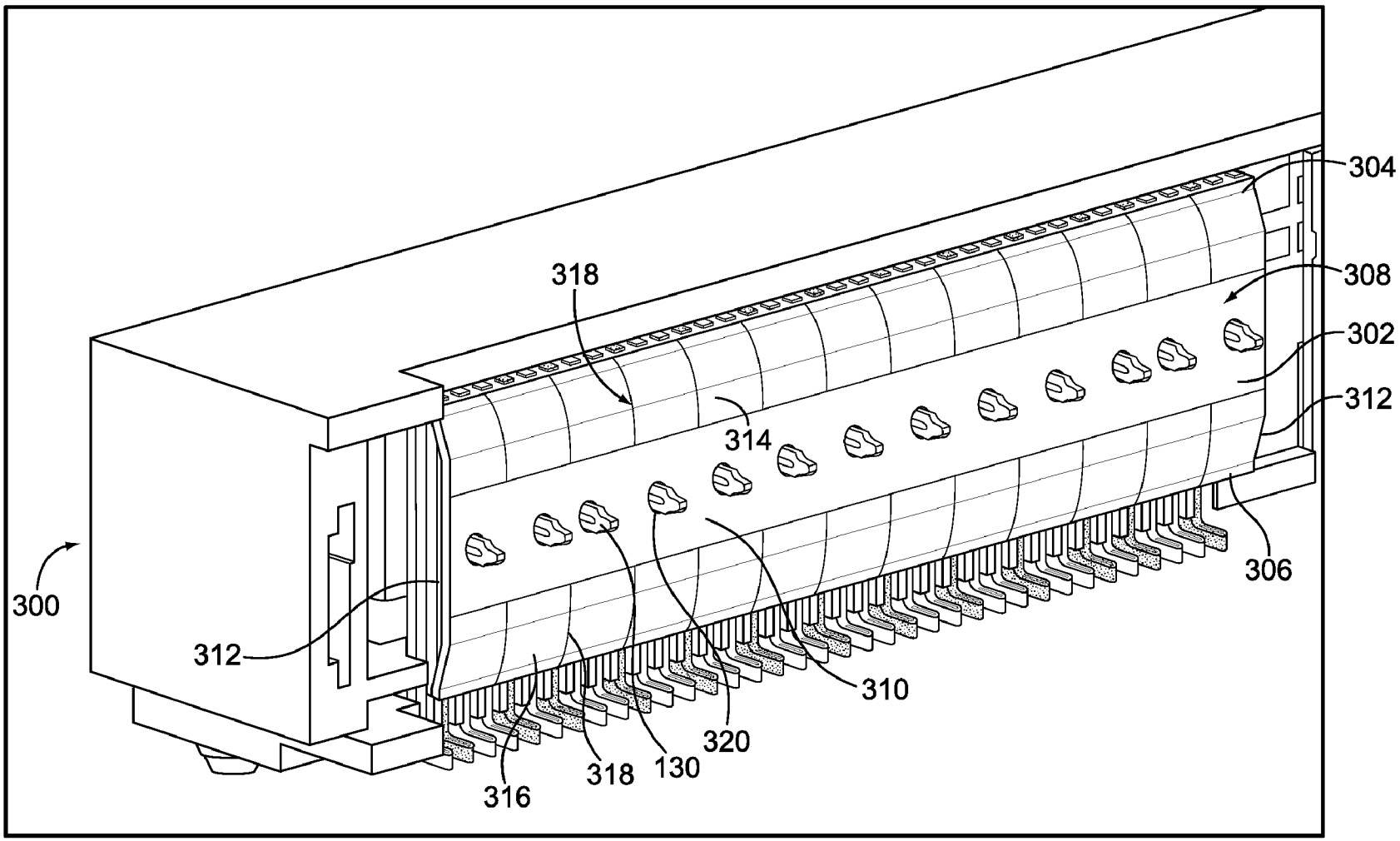
FIG. 9 is a perspective view of an alternative socket connector.

FIG. 9 is a rear perspective view of an alternative socket connector 300 showing alternative power plates 302. The socket connector 300 is similar to the socket connector 12, however, the socket connector 300 utilizes power plates 302 that differ from the power plates 100 (shown in FIG. 3). In the illustrated embodiment, the other components of the socket connector 300 are the same as the socket connector 12 and such components are identified with the same reference numbers.

The power plates 302 are connected to the power contacts 72 to electrically common a plurality of the power contacts 72 to one another. The power plates 302 define a secondary power or current path between the top and the bottom of the power contacts 72 that is parallel to the power path defined by the power contacts 72. In the illustrated embodiment, multiple power plates 302 are provided that electrically common different subsets of the power contacts 72 together. Any number of power plates 302 may be utilized, depending on the particular application.

Each power plate 302 includes a metallic body extending between an upper end 304 and a lower end 306. The power plate 302 is convex with the upper and lower ends 304, 306 engaging the power contacts 72. A central portion 308 of the power plate 302 defines a band 310 that extends between opposed sides 312 of the power plate 302.

A plurality of upper arms 314 extend from a top of the band 310 to the upper end 304 of the power plate 302 and a plurality of lower arms 316 extend from a bottom of the band 310 to the lower end 306 of the power plate 302. Alternatively, the arms only extend from either the top or the bottom of the band 310 such that only upper arms 314 or only lower arms 316 are provided.

Adjacent arms 314 are separated by a slit 318 such that the arms 314 are capable of moving independently with respect to one another. The slits 318 may be very narrow such that the arms 314 essentially touch one another. Alternatively, the slits 318 may be wide such that the arms 314 are separated from one another by a noticeable gap. The slits 318 may be cut into the power plate 302 after the power plate 302 is formed. Alternatively, the slits 318 may be formed simultaneously with the power plate 302, such as during a stamping process and prior to forming the power plate 302.

The central portion 308 of the power plate 302 is bowed outward such that the band 310 is positioned outward with respect to the upper and lower ends 304, 306 to give the power plate 302 a convex shape. When the power plate 302 is connected to the power contacts 72, the band 310 may be pushed inward toward the power contacts 72.

The band 310 includes a plurality of openings 320 that receive the central commoning elements 130 to secure the power plate 302 to the power contacts 72. During assembly, the arms 314, 316 are placed against the outer edge of the power contacts 72 and the band 310 is pushed inward toward the power contact 72 to load the central commoning elements 130 through the openings 320. The band 310 is held in place by an interference engagement with the central commoning elements 130. Alternatively, the power plate 302 may be held in position by another component, such as a cover (not shown) that is secured to the rear of the housing 60 (shown in FIG. 2) and that holds the power plate 100 in physical contact with the power contact 72. As the band 310 is pushed inward toward the power contacts 72, the upper and lower ends 304, 306 deflect relative to the central portion 308 and the power plate 302 widens. In the deflected state, the arms 314, 316 engage the upper and lower commoning elements 128, 132 (shown in FIG. 4) of the power contacts 72. Optionally, each arm 314, 316 engages more than one power contact 72. Alternatively, each arm 314, 316 engages only one power contact 72.

Because the arms 314, 316 are capable of moving independently, the arms 314, 316 accommodate changes in positions of the commoning elements 126. For example, the positions of the commoning elements 126 may vary due to manufacturing tolerances of the housing 60 and/or of the power contacts 72. Additionally, the positions of the commoning elements 126 may vary due to improper assembly, such as by not fully loading the power contacts 72 into the housing 60 or by overloading the power contacts 72 into the housing 60, which changes the relative positions of the outer edge of the power contacts 72. The arms 314, 316 accommodate the variations in positions of the power contacts 72 to ensure physical contact with each of the power contacts 72.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A socket connector comprising:

a housing having a mating interface configured to mate with an electronic component and a mounting interface configured to mount to a circuit board, signal contacts held by the housing and extending between the mating interface and the mounting interface;

power contacts held by the housing and extending between the mating interface and the mounting interface, the power contacts being configured to transmit power from the circuit board to the electronic component, each of the power contacts having a commoning element; and a metallic power plate mounted to the commoning elements of the power contacts and held by the power contacts to electrically common the power contacts to one another; wherein the power plate includes a plate-like body extending between a top and a bottom, the power plate engaging corresponding power contacts proximate to the top of the power plate and the power plate engaging corresponding power contacts proximate to the bottom of the power plate.

2. The socket connector of claim 1, wherein the power plate defines secondary power paths between upper portions and lower portions of the power contacts, the secondary power paths being generally parallel to power paths defined by the power contacts.

3. The socket connector of claim 1, wherein each power contact includes a contact tail at the mounting interface, a contact base extending perpendicular from the mounting interface to a contact beam extending from the contact base, the power contact having more than one commoning element with an upper commoning element proximate to the contact beam and a lower commoning element proximate to the contact tail.

4. The socket connector of claim 1, wherein one or more of the signal contacts are positioned between adjacent ones of the power contacts.

5. The socket connector of claim 1, wherein the commoning elements comprise eye-of-the-needle-type contacts extending outward from corresponding power contacts, the power plate having a plurality of openings receiving the eye-of-the-needle-type contacts to electrically connect to the power contacts, the eye-of-the-needle-type contacts holding the power plate by an interference engagement with the openings.

6. The socket connector of claim 1, wherein the power plate includes a metallic body extending between an upper end and a lower end, the power-plate being convex with the upper and lower ends engaging corresponding commoning elements of the power contacts.

7. The socket connector of claim 1, wherein the power plate is convex with a central portion of the power plate being flexed toward the power contacts to straighten the power plate during mating with the power contacts.

8. The socket connector of claim 1, wherein the housing includes a slot extending along a connector axis, the slot being configured to receive an edge of the electronic component and having contact pads arranged along the edge, the power contacts being exposed within the slot for mating with the contact pads.

9. The socket connector of claim 1, wherein the power plate includes a band extending along a plate axis, the power plate having a plurality of arms extending outward from the band in directions generally perpendicular to the plate axis, the power plate being coupled to the commoning elements of the power contacts such that adjacent arms engage different power contacts.

10. The socket connector of claim 1, wherein the power plate engages the corresponding power contacts at least two different points of such power contacts.

11. The socket connector of claim 1, wherein the housing has a rear end opposite the mating interface, the power plate being mounted to the power contacts along the rear end.

12. A socket connector comprising:

a housing having a mating interface configured to mate with an electronic component and a mounting interface configured to mount to a circuit board, signal contacts held by the housing and extending between the mating interface and the mounting interface;

power contacts held by the housing and extending between the mating interface and the mounting interface, the power contacts being configured to transmit power from the circuit board to the electronic component, each of the power contacts having a commoning element, wherein each power contact includes a contact tail at the mounting interface, a contact base extending perpendicular from the mounting interface to a contact beam extending from the contact base, the contact beam being exposed at the mating interface for mating with the electronic component, the commoning element being arranged on the contact base; and a metallic power plate coupled to the commoning elements of a plurality of the power contacts to electrically common the power contacts to one another.

13. The socket connector of claim 12, wherein the power plate includes a metallic body extending between an upper end and a lower end, the power-plate being convex with the upper and lower ends engaging corresponding commoning elements of the power contacts.

14. The socket connector of claim 12, wherein the power plate is convex with a central portion of the power plate being flexed toward the power contacts to straighten the power plate during mating with the power contacts.

15. The socket connector of claim 12, wherein the power plate is loaded onto the commoning element and secured to the power contact by an interference engagement with the commoning element.

16. The socket connector of claim 12, wherein the power plate includes a plate-like body extending between a top and a bottom, the power plate engaging corresponding power contacts at the top of the power plate and the power plate engaging corresponding power contacts at the bottom of the power plate.

17. A socket connector comprising:

a housing having a mating interface configured to mate with an electronic component and a mounting interface configured to mount to a circuit board, signal contacts held by the housing and extending between the mating interface and the mounting interface;

power contacts held by the housing and extending between the mating interface and the mounting interface, the power contacts being configured to transmit power from the circuit board to the electronic component, each of the power contacts having at least two commoning elements; and a power plate coupled to the at least two commoning elements of the power contacts to electrically common the power contacts to one another, wherein the power plate is loaded onto the commoning element and secured to the power contact by an interference engagement with the commoning element; wherein the power plate includes a plate-like body extending between a top and a bottom, the power plate engaging corresponding power contacts proximate to the top of the power plate and the power plate engaging corresponding power contacts proximate to the bottom of the power plate.

18. The socket connector of claim 17, wherein the power plate defines secondary power paths between upper portions and lower portions of the power contacts, the secondary power paths being generally parallel to power paths defined by the power contacts.

19. The socket connector of claim 17, wherein the commoning elements comprise eye-of-the-needle-type contacts extending outward from corresponding power contacts, the power plate having a plurality of openings receiving the eye-of-the-needle-type contacts to electrically connect to the power contacts, the eye-of-the-needle-type contacts holding the power plate by an interference engagement with the openings.

20. The socket connector of claim 17, wherein the power contacts include opposed mounting tabs defining the commoning elements, the power plate extends between a top end and a bottom end, the top and bottom ends being folded over to define clip portions engaging the opposed mounting tabs by an interference engagement to secure the power plate to the power contacts.

21. The socket connector of claim 17, wherein the power plate is convex with a central portion of the power plate being flexed toward the power contacts to straighten the power plate during mating with the power contacts.

* * * * *